US011844410B2

(12) United States Patent
Woodland et al.

(10) Patent No.: US 11,844,410 B2
(45) Date of Patent: Dec. 19, 2023

(54) COSMETIC PRODUCT REFILL FOR A HAIR TREATMENT DEVICE

(71) Applicants: L'OREAL, Paris (FR); SEB S.A., Ecully (FR)

(72) Inventors: Frederic Woodland, Saint-Ouen (FR); Stefania Nuzzo, Saint-Ouen (FR); Gabin Vic, Saint-Ouen (FR); Sandy Lapize, Saint-Ouen (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 714 days.

(21) Appl. No.: 16/463,126

(22) PCT Filed: Dec. 13, 2017

(86) PCT No.: PCT/EP2017/082656
§ 371 (c)(1),
(2) Date: May 22, 2019

(87) PCT Pub. No.: WO2018/109021
PCT Pub. Date: Jun. 21, 2018

(65) Prior Publication Data

US 2019/0289980 A1 Sep. 26, 2019

(30) Foreign Application Priority Data

Dec. 15, 2016 (FR) ..... 1662511

(51) Int. Cl.
*A45D 34/00* (2006.01)
*A45D 2/00* (2006.01)
(Continued)

(52) U.S. Cl.
CPC ..... *A45D 34/00* (2013.01); *A45D 1/00* (2013.01); *A45D 1/02* (2013.01); *A45D 2/001* (2013.01);
(Continued)

(58) Field of Classification Search
CPC ... A45D 1/00; A45D 1/04; A45D 1/06; A45D 1/08; A45D 2001/008; A45D 2/001; A45D 2/40; A45D 19/16; A45D 19/0041
See application file for complete search history.

(56) References Cited

U.S. PATENT DOCUMENTS 7,455,850 B2 * 11/2008 Zheng ..... A61K 8/39 424/401
2006/0140895 A1 * 6/2006 Zheng ..... A61K 8/39 424/70.12
(Continued)

FOREIGN PATENT DOCUMENTS

CN 105725445 A 7/2016
EP 3 039 988 A1 7/2016
(Continued)

OTHER PUBLICATIONS

Combined Chinese Office Action and Search Report dated Jun. 16, 2020 in Patent Application No. 201711340786.1 (with English language translation and English translation of Category of Cited Documents), 16 pages.
(Continued)

*Primary Examiner* — Cris L. Rodriguez
*Assistant Examiner* — Karim Asqiriba
(74) *Attorney, Agent, or Firm* — Oblon, McClelland, Maier & Neustadt, L.L.P.

(57) ABSTRACT

The invention relates to a cosmetic product refill (20) for a hair treatment device (1), comprising an applicator member that is saturated with liquid cosmetic product, with a degree of filling less than or equal to 90%, preferably less than or equal to 80%>, more preferably less than or equal to 70%, the degree of filling being defined as the ratio of the mass of cosmetic product in the applicator member divided by the
(Continued)

maximum mass of cosmetic product with which the applicator member can be saturated.

21 Claims, 8 Drawing Sheets

(51) Int. Cl.
*A45D 1/00* (2006.01)
*A45D 1/02* (2006.01)

(52) U.S. Cl.
CPC .. *A45D 2001/002* (2013.01); *A45D 2001/008* (2013.01); *A45D 2034/005* (2013.01)

(56) References Cited

U.S. PATENT DOCUMENTS

2009/0025247 A1 1/2009 Yde et al.
2009/0180826 A1 7/2009 Guay
2010/0269848 A1* 10/2010 Morgandi ..... A45D 1/04 132/269
2013/0153461 A1* 6/2013 Hein ..... A45D 34/042 206/581
2013/0233335 A1* 9/2013 Hein ..... A45D 1/04 132/221
2015/0173480 A1* 6/2015 Washington ..... A45D 2/367 132/206
2015/0289622 A1* 10/2015 Fereyre ..... A45D 1/06 132/211
2016/0296449 A1* 10/2016 Kadir ..... A61Q 5/04
2017/0340084 A1 11/2017 Fereyre et al.

FOREIGN PATENT DOCUMENTS

FR 2 879 083 A1 6/2006
JP 49-135724 A 12/1974
JP 3150535 U 5/2009
JP 2011-509110 A 3/2011
WO WO 2009/015027 A2 1/2009
WO WO 2009/078046 A1 6/2009
WO WO 2013/045331 A1 4/2013
WO WO 2013/090896 A1 6/2013

OTHER PUBLICATIONS

Notice of Reasons for Refusal dated Jul. 20, 2020 in Japanese Patent Application No. 2019-531947 (with English language translation), 12 pages.
Japanese Office Action dated May 17, 2021 in Japanese Patent Application No. 2019-531947 (with English translation), 12 pages.
International Search Report dated Jan. 22, 2018 in PCT/EP2017/082656 filed on Dec. 13, 2017.
Preliminary French Search Report dated Aug. 21, 2017 in FR 1662511 filed on Dec. 15, 2016.

* cited by examiner

| Filling of applicator member [in %] | Mass of product deposited [in g] | η [in %] |
|---|---|---|
| 99.9 | 0.185 | 70.0 |
| 91.2 | 0.163 | 49.5 |
| 83.4 | 0.132 | 20.8 |
| 75.5 | 0.110 | 1.2 |
| 67.5 | 0.110 | 0.8 |
| 58.0 | 0.105 | 3.4 |
| 50.6 | 0.105 | 3.7 |
| 42.5 | 0.077 | 28.9 |
| 33.0 | 0.057 | 47.8 |
| 27.1 | 0.045 | 58.7 |

Fig. 7: sample E1

| Filling of applicator member [in %] | Mass of product deposited [in g] | η [in %] |
|---|---|---|
| 97.3 | 0.236 | 220.2 |
| 87.3 | 0.106 | 43.6 |
| 79.3 | 0.084 | 13.8 |
| 69.3 | 0.063 | 14.3 |
| 59.4 | 0.063 | 14.6 |
| 47.7 | 0.035 | 52.8 |
| 38.3 | 0,036 | 50.7 |
| 27.8 | 0.029 | 61.3 |
| 18.8 | 0.012 | 83.6 |

Fig. 8: sample E2

| Filling of applicator member [in %] | Mass of product deposited [in g] | η [in %] |
|---|---|---|
| 100.0 | 0.161 | 202.6 |
| 91.2 | 0.090 | 69.5 |
| 82.5 | 0.054 | 1.9 |
| 72.8 | 0.043 | 20.0 |
| 62.7 | 0.029 | 45.9 |
| 43.5 | 0.023 | 56.5 |
| 33.9 | 0.01 | 81.6 |
| 24.7 | 0.016 | 70.0 |

Fig. 9 : sample E3

| Filling of applicator member [in %] | Mass of product deposited [in g] | η [in %] |
|---|---|---|
| 100.0 | 0.06 | 175.9 |
| 90.7 | 0.026 | 20.8 |
| 80.5 | 0.022 | 3.7 |
| 71.1 | 0.015 | 30.6 |
| 61.4 | 0.014 | 33.8 |
| 51.7 | 0.013 | 39.4 |
| 42.1 | 0.011 | 50.9 |
| 33.1 | 0.012 | 45.8 |

Fig. 10 : sample E4

| Filling of applicator member [in %] | Mass of product deposited [in g] | η [in %] |
|---|---|---|
| 100.9 | 0.149 | 220.2 |
| 91.8 | 0.073 | 58.5 |
| 83.9 | 0.068 | 46.4 |
| 75.2 | 0.042 | 10.1 |
| 65.9 | 0.032 | 31.9 |
| 57.6 | 0.018 | 61.0 |
| 49.3 | 0.015 | 66.6 |
| 40.2 | 0.010 | 78.0 |
| 33.9 | 0.010 | 77.6 |

Fig. 11 : sample E5

| Filling of applicator member [in %] | Mass of product deposited [in g] | η [in %] |
|---|---|---|
| 100.0 | 0.057 | 140.9 |
| 89.9 | 0.031 | 28.5 |
| 80.6 | 0.017 | 29.2 |
| 71.9 | 0.025 | 5.3 |
| 66.5 | 0.022 | 5.6 |
| 66.0 | 0.025 | 3.6 |
| 59.1 | 0.021 | 11.5 |
| 54.9 | 0.019 | 18.3 |
| 48.6 | 0.012 | 50.7 |
| 45.6 | 0.009 | 62.9 |

Fig. 12 : sample E6

| Filling of applicator member [in %] | Mass of product deposited [in g] | η [in %] |
|---|---|---|
| 100.2 | 0.179 | 129.9 |
| 90.0 | 0.102 | 30.7 |
| 81.4 | 0.097 | 20.4 |
| 71.2 | 0.062 | 20.4 |
| 62.4 | 0.053 | 32.2 |
| 53.1 | 0.047 | 40.2 |
| 43.7 | 0.049 | 37.4 |
| 35.1 | 0.035 | 55.3 |

Fig. 13 : sample E7

COSMETIC PRODUCT REFILL FOR A HAIR TREATMENT DEVICE

The present invention relates to cosmetic product refills for hair treatment devices, and more particularly, but not exclusively, those for devices for shaping the hair, notably intended for straightening, curling or crimping the hair.

The invention also relates to devices provided with such a refill and to the methods for treating the hair.

BACKGROUND

Usually, hair straighteners consist of two arms that are connected together with the aid of a hinge which makes it possible to open and close said arms, and of at least one heating element disposed on the arms. During operations of styling a lock of hair, said lock is introduced between the two arms in the open position and then the two arms are closed manually over the lock of hair. The latter is then subjected to the heat output by the heating element, until the two arms are opened and the lock of hair is removed.

The application WO 2009/078046 describes a hairstyling appliance comprising two arms that are connected together so as to allow the appliance to be opened and closed, at least one heating member and at least one seat for accommodating a hair treatment device, the latter allowing a haircare product to be dispensed during operation. The hair treatment device comprises a support material impregnated with a haircare product and suitable for a single use.

WO 2009/015027 and US 2009/0025247 disclose a hair straightening device that makes it possible to apply a haircare product by contact with the hair. The haircare product to be applied is contained in a removable refill for the application thereof. Said removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding.

The application WO 2013/045331 likewise discloses an applicator for applying a care substance to the hair, comprising a cartridge of care substance held in a housing of the applicator. The cartridge comprises a porous support saturated with the care substance.

The application WO 2013/090896 relates to a hair treatment appliance, in particular a hairstyling appliance, comprising a treatment agent holder, notably a saturated porous material, to be applied to the hair or the skin. The holder is fixed to an accessory, which is itself mounted in a removable manner on a hair treatment appliance. The holder is T-shaped, allowing it to be mounted in a complementary groove in the accessory.

There is a need to further improve devices for applying a haircare product so as to ensure adequate application of cosmetic product.

SUMMARY OF THE INVENTION

To this end, the invention proposes a cosmetic product refill for a hair treatment device, comprising an applicator member, saturated with liquid cosmetic product, with a degree of filling less than or equal to 90%.

The applicator member, when saturated with at most 90% of liquid cosmetic product, tends to restore a substantially consistent quantity of product on each pass over the hair, thereby allowing the relatively homogeneous treatment of a complete head of hair. By comparison, when the applicator member is completely saturated, it tends to deliver a greater quantity of product during the first passes and a smaller quantity of product during subsequent passes. In this case, the treatment of the hair that is obtained is less homogeneous, and the parts of the hair treated during the first or last passes, having received different quantities of cosmetic product, may not have a satisfactory cosmetic feel.

Preferably, the cosmetic product refill according to the invention has one or more of the following features, on their own or in combination:

- the degree of filling of the applicator member is less than or equal to 80%, more preferably less than or equal to 70%;
- the applicator member is entirely porous;
- the applicator member is made of felt, it being possible for the fibers of the felt all to be oriented substantially in the same direction and molded so as to form the felt, the fibers preferably being oriented either perpendicularly to the surface of the lock of hair to be treated or parallel to a longitudinal direction of the applicator member;
- the density of the applicator member is greater than 0.08 g/cm$^3$ and/or less than 0.350 g/cm$^3$;
- the viscosity of the cosmetic product is greater than 4 centipoise and/or less than 500 centipoise;
- the applicator member has a degree of filling greater than or equal to 40%, preferably greater than or equal to 50%, more preferably greater than or equal to 60%;
- the applicator member has an elongate shape, with a rectangular or cruciform cross section, with a flat, pointed or rounded end that is intended to be in contact with the hair to be treated, and/or with one or two bevels;
- the applicator member is made at least partially, better still entirely, of polyethylene, of polypropylene, or of a mixture of polyethylene and polypropylene, the mixture preferably comprising between 45 and 55% polyethylene and 55 and 45% polypropylene;
- the liquid cosmetic product is an aqueous composition, the viscosity of which is preferably greater than 4 centipoise and/or less than 100 centipoise, at 22° C. and 1013.25 hPa, the applicator member preferably having a density greater than 0.11 g/cm$^3$ and/or less than 0.25 g/cm$^3$;
- the liquid cosmetic product is an anhydrous composition, comprising notably an oil, the viscosity of which is preferably greater than 100 centipoise and/or less than 500 centipoise, at 22° C. and 1013.25 hPa, the applicator member preferably having a density greater than 0.11 g/cm$^3$ and/or less than 0.25 g/cm$^3$; and
- the cosmetic product refill comprises a body delimiting a cavity that is formed at least partially by two opposite walls and a bottom and opens toward the outside by way of an opening, said applicator member being partially received in said cavity and extending partially out of the cavity, through the opening.

According to another aspect, the invention relates to a cosmetic product refill article, comprising a closed package and at least one cosmetic product refill as defined above in all the combinations thereof, contained in the package.

The invention also relates to a hair treatment device, comprising:

- at least one arm,
- a cosmetic product refill as described above in all the combinations thereof, which is mounted on the arm.

Preferably, the refill is disposed in a removable manner in a housing of the arm.

Preferably, the hair treatment device comprises two arms that are able to move relative to one another between a moved-together configuration for treating the hair and a spaced-apart configuration for inserting hair to be treated between said arms.

According to one variant, at least one of the arms, preferably each arm, comprises a heating element for the hair to be treated.

Preferably, the device is a hair straightener, notably a straightening iron.

According to yet another aspect, the invention relates to a ready-to-assemble hair treatment assembly, comprising:

- a hair treatment appliance, comprising at least one arm provided with a heating element for the hair, the hair treatment appliance comprising, on one of these arms, a receiving housing suitable for receiving a cosmetic product refill, and
- a cosmetic product refill article as defined above, in all the combinations thereof.

According to yet another aspect, the invention relates to a method for treating the hair, comprising the step of applying a cosmetic product to a lock of hair with the aid of the device according to the invention.

Preferably, the treatment is carried out by moving the device along the lock of hair, the arms of said device being held in the moved-together configuration during said movement.

The invention may be understood better from reading the following detailed description of nonlimiting illustrative embodiments thereof and from studying the appended drawing, in which.

Figure 3:
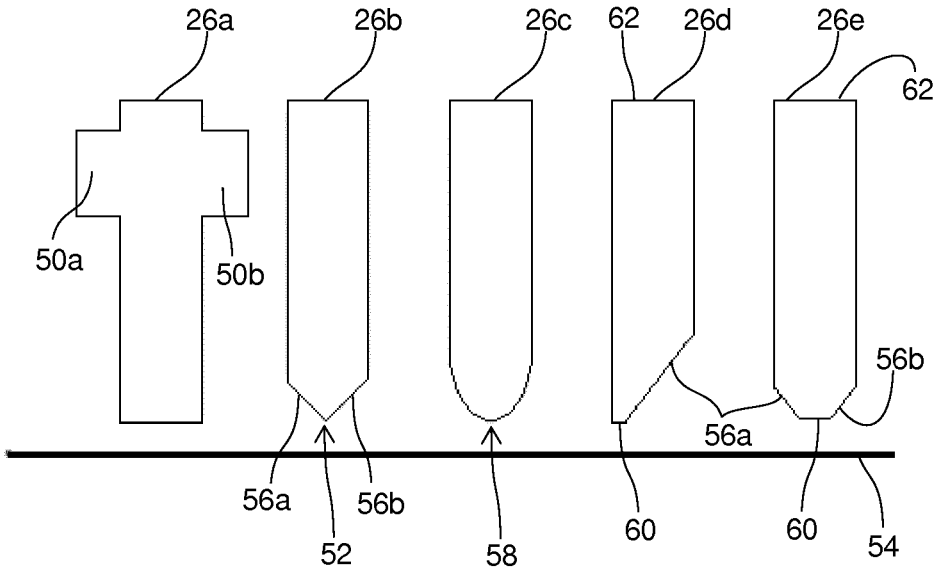

FIG. 3 illustrates, in cross section, examples of applicator members that can be employed in the hair treatment device in FIG. 1, FIGS. 4 to 6 show curves of the quantity of product deposited per lock of hair as a function of the degree of filling of the applicator member, for various applicator members made of different porous materials, The tables in FIGS. 7 to 13 give the numeric values of tests carried out with each of the samples in order to draw the curves in FIGS. 4 to 6, and FIG. 14 schematically illustrates a ready-to-assemble hair treatment assembly.

In the rest of the description, identical elements or elements having identical functions bear the same reference signs. In order to make the present description concise, they are not described for each of the figures, only the differences between the embodiments being described.

Figure 1:
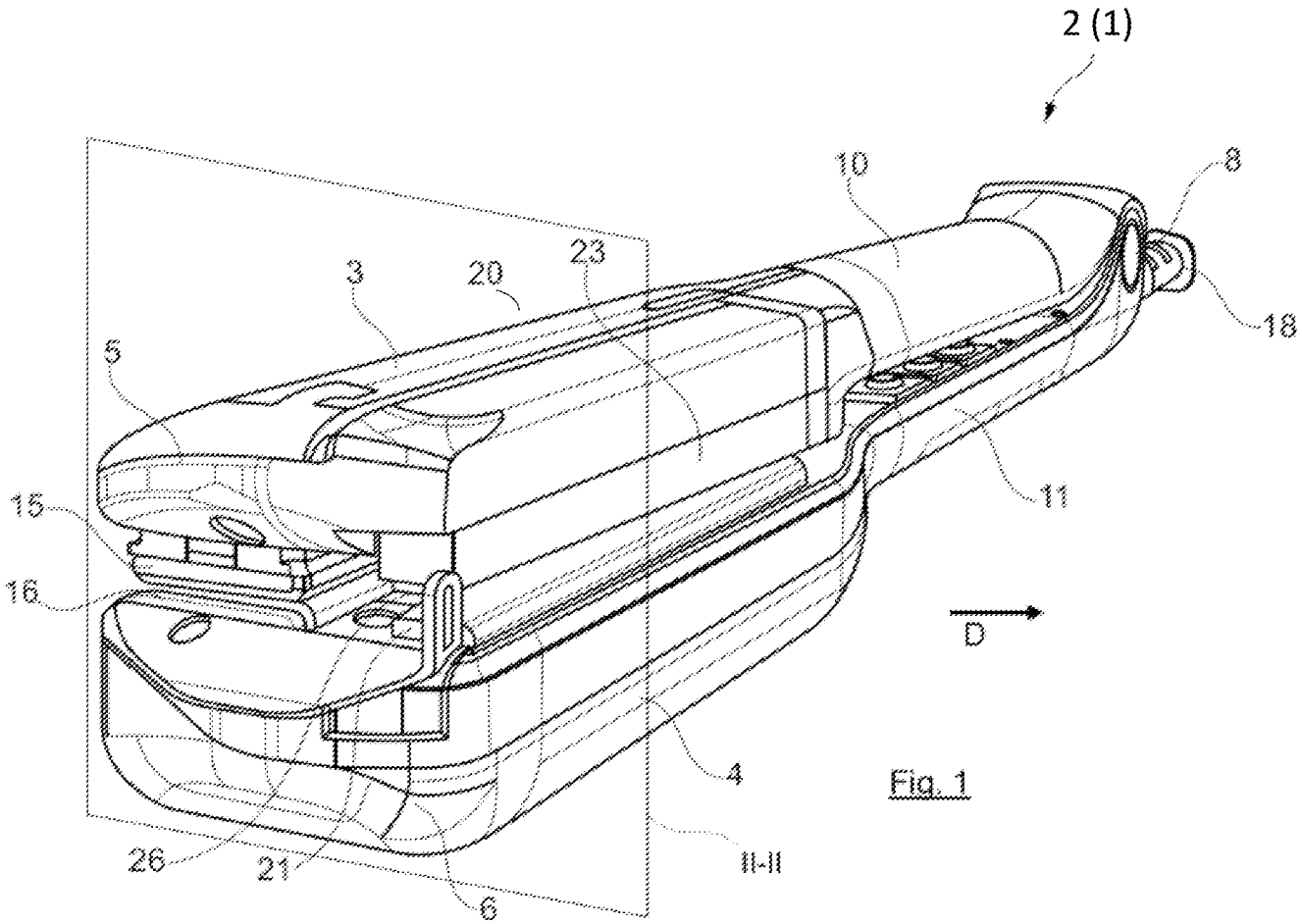
FIG. 1 shows a perspective view of an example of a hair treatment device.
Figure 2:
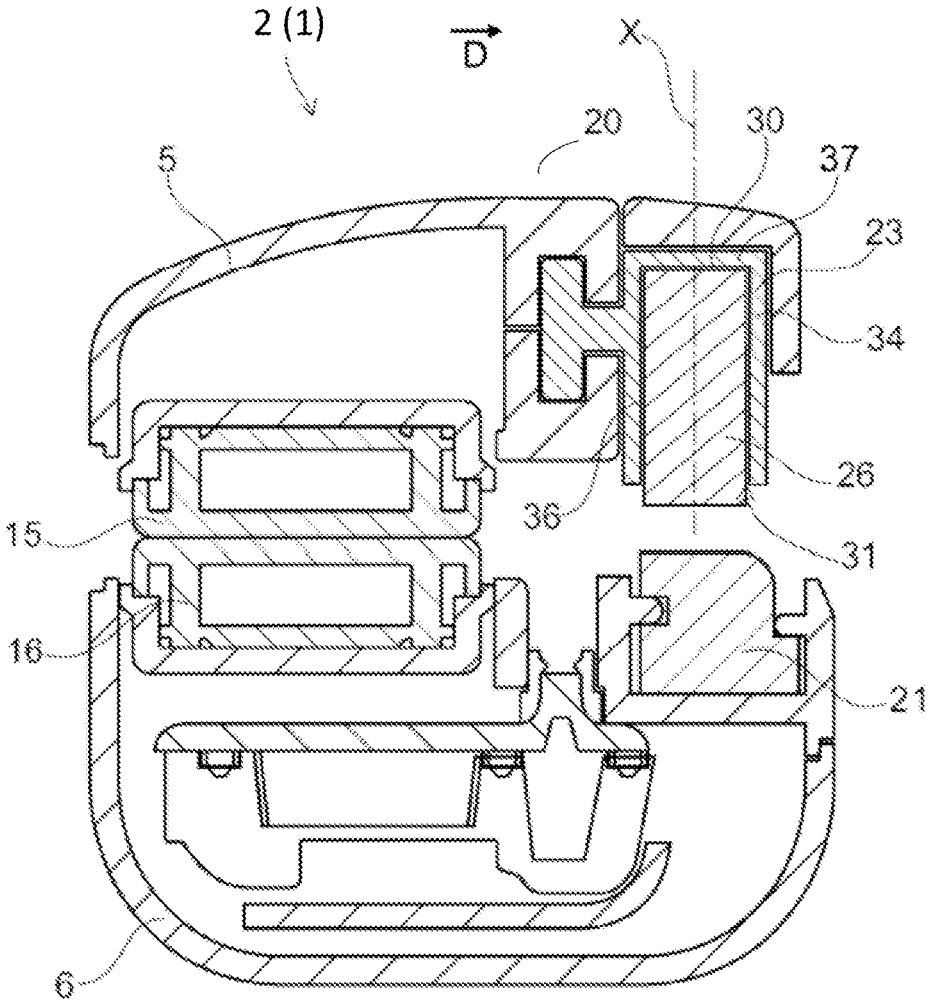
FIG. 2 is a cross-sectional view on II-II in FIG. 1.

FIGS. 1 and 2 show the handpiece 2 of an example of a hair treatment device 1.

This handpiece 2 has two jaws 3 and 4 that are able to move with respect to one another between a spaced-apart configuration (not shown) for the introduction of a lock of hair between said jaws, and a moved-together configuration for treating the lock of hair.

The jaws 3 and 4 are carried by an upper arm 5 and a lower arm 6, respectively, which, in the example in question, are connected together at one end by an articulation 8, the handpiece 2 thus forming tongs.

The upper arm 5 and lower arm 6 each preferably have a total length of between 22 cm and 37 cm and define, between the articulation 8 and the jaws 3 and 4, respective half-handles 10 and 11 on which the user can press in order to move the jaws 3 and 4 together.

An elastic return member (not visible) is preferably provided to return the jaws 3 and 4 to a spaced-apart configuration, this elastic return member being for example a spring disposed around an articulation pin 8.

The invention is not limited to a particular manner of connecting the upper arm 5 and lower arm 6 together and the jaws 3 and 4 may be rendered able to move in some other way without departing from the scope of the present invention. However, the presence of an articulation is largely preferred for the ergonomics it provides.

The jaws 3 and 4 define between them a region for treating the hair, said region being intended to receive a lock of hair to be treated, the handpiece 2 being moved along said lock during the treatment, for example in the direction from the root to the end of the hair.

In the example in question, the handpiece 2 is configured to apply a cosmetic product, to treat the hair by way of steam and then to carry out a heat treatment of the hair by contact with two hot surfaces of heating elements 15 and 16 that are carried by the upper arm 5 and the lower arm 6, respectively.

The direction D of movement of the handpiece 2 over the hair, illustrated in FIG. 1 or 2, is preferably substantially perpendicular to the upper arm 5 and lower arm 6.

The handpiece 2 is connected by a line 18, in the example in question, to a base station (not shown) that is fixed during the treatment and is connected to the mains.

This base station provides electric power to the handpiece 2 and also its supply of water for generating steam, and may also carry out additional functions of processing electrical signals received from the handpiece 2. The line 18 which connects the handpiece 2 to the base station may thus comprise various electrical conductors and a water supply pipe.

A user interface (not shown in the figures) may be present on the handpiece 2 so as to give the user the option for example of starting up certain components thereof.

The cosmetic product is applied by a refill 20 carried by one of the two arms, 5 or 6, in this case the upper arm 5, which comes into contact with a pressing element 21. The latter may be removable.

The refill 20 comprises a body 23 and an applicator member 26 disposed so as to come into contact with the hair extending through the treatment region. The refill 20 may be fastened to the arm 5 or 6 by any means, notably, as illustrated in FIG. 2, by sliding a rib of the body 23 into a groove with a complementary shape.

As illustrated in FIG. 2, the body 23 has a cavity 30 that opens toward the outside by way of an opening 31 into which the applicator member 26 is inserted, along an insertion axis X, while the refill is being manufactured. More specifically, the cavity 30 is formed at least partially by two opposite walls 34, 36 and a bottom 37 of the body 23. The cavity 30 opens toward the outside by way of an opening 31. The applicator member 26 is partially received in the cavity 30 and extends partially out of the latter, through the opening 31. The body may comprise coupling reliefs that extend into the cavity 30.

The body 23 substantially has an elongate shape along a longitudinal axis. In cross section, the body 23 is U-shaped, as illustrated in FIG. 2.

As illustrated in FIG. 2, the applicator member 26 may be in the form of a rectangular parallelepiped. The applicator member 26 thus has a substantially flat face that is intended to be in contact with the hair to be treated. The dimensions of the applicator member 26 are for example 8 mm×20 mm×90 mm, the face intended to be in contact with the hair having dimensions of 8 mm×90 mm.

However, FIG. 3 illustrates possible variants of the applicator member 26. The applicator member 26*a* may have a cruciform cross section with, compared with the applicator member 26 in FIG. 2, two parallelepipedal longitudinal ribs 50*a*, 50*b*.

The applicator member 26*b* may have, compared with the applicator member 26 in FIG. 2, a point 52 intended to be in contact with the hair 54 to be treated. This point 52 is formed by two bevels 56*a*, 56*b* with opposite orientations.

The applicator member 26*c* has, in cross section, an ogival shape, the rounded end 58 of the ogive being intended to be oriented toward the hair 54.

The applicator member 26*d* has, compared with the applicator member 26*b*, a single bevel 56*a*. The applicator member 26*d* thus has a surface 60, intended to be in contact with the hair 54, that is parallel to the opposite surface 62 and has limited dimensions.

Finally, the applicator member 26*e* has two opposite bevels 56*a*, 56*b* that are connected by a central portion 60, intended to be in contact with the hair 54, which extends substantially parallel to the opposite surface 62 of the applicator member 26*e*.

Other applicator member shapes may also be envisioned, notably by combining the variants in FIG. 3.

The applicator member may be made of polyethylene, of polypropylene or of a mixture of polyethylene and polypropylene. The mixture may notably comprise 50% polyethylene and 50% polypropylene.

The applicator member may be a felt. The fibers of the felt may be oriented parallel to the surface of the lock of hair 54 to be treated, the fibers preferably being oriented substantially in a longitudinal direction of the applicator member, perpendicularly to the direction D of passage over the hair. In one variant, the fibers of the felt of the applicator member are oriented perpendicularly to the surface of the lock of hair 54 to be treated, i.e. perpendicularly to the direction D and to the longitudinal direction of the applicator member 26.

The applicator member may comprise at least two parts having different fiber densities and/or fiber orientations. Notably, a part with a lower fiber density may act as a reservoir, while the other part, with a higher fiber density, allows more homogeneous application of the cosmetic product to the lock of hair to be treated. In this way, the variation in quantity of product delivered onto one and the same lock is reduced, depending on the position on the lock.

The applicator member is for example initially saturated with a volume of liquid cosmetic product greater than 6 ml, preferably greater than 10 ml and/or less than 14 ml, preferably less than 11 ml. The applicator member has for example a density greater than 0.08 g/cm$^3$, preferably greater than 0.1 g/cm$^3$, and/or less than 0.35 g/cm$^3$, preferably less than 0.25 g/cm$^3$, more preferably less than 0.23 g/cm$^3$. The viscosity of the cosmetic product is for example greater than 4 centipoise, preferably greater than 5 centipoise, and/or less than 500 centipoise, preferably less than 100 centipoise. The viscosity of the cosmetic product is measured at a pressure of 1.01325 $10^5$ Pa, at a temperature of 22° C. and at a shear rate of 1 $s^{-1}$. This viscosity may be measured using a cone/plate viscometer (Haake R600 rheometer or the like).

The cosmetic product may notably be an aqueous composition, notably in the form of an emulsion. An aqueous composition is understood to be a composition comprising water. The emulsion is preferably direct and its solids content is less than 10%. The aqueous composition has for example a viscosity greater than 4 centipoise, preferably greater than 5 centipoise, and/or less than 100 centipoise.

In a variant, the cosmetic product is an anhydrous composition.

Within the meaning of the present invention, an "anhydrous composition" is understood to be a composition containing less than 5% by weight of water, and preferably less than 1% by weight of water, relative to the total weight of the composition. More preferably, the anhydrous composition does not contain any water added during the preparation of the composition, the only water present corresponding to the residual water provided by the mixed ingredients. Even more preferably, the anhydrous composition is free of water.

The anhydrous composition may comprise at least one oil. It may notably comprise a mixture of silicones.

The anhydrous composition has for example a viscosity greater than 100 centipoise and/or less than 500 centipoise.

The initial quantity of cosmetic product present in the applicator member corresponds to a degree of filling of the applicator member less than 90%, preferably less than 80%, more preferably less than 70%.

The "degree of filling" is understood to be the ratio of the mass of cosmetic product in the applicator member divided by the maximum mass of cosmetic product with which the applicator member can be saturated. A degree of filling of 100% is obtained by dipping the felt in the cosmetic product for at least 5 minutes. A degree of filling less than 100% is obtained by filling the applicator member to 100% and then removing the excess cosmetic product by applying an absorbent fabric to all of the faces of the applicator member until the desired degree of filling has been obtained.

The inventors have found that, when the applicator member is not completely saturated with cosmetic product but rather has a degree of filling as indicated above, the quantity of cosmetic product delivered on each pass over the hair to be treated exhibits less significant variations. This quantity of liquid delivered may notably have a certain consistency, notably a variation less than 30%, at least as far as a certain degree of filling, compared with a mean value of quantity of cosmetic product delivered for a range of filling of the applicator member that varies from 30 or 40% to 100%. On account of the consistency of the quantity of cosmetic product delivered, it is possible to obtain a more regular cosmetic result on all of a user's hair. Of course, the consistency of the quantity of cosmetic product delivered implies that the conditions of application of the cosmetic product, notably the speed of passage and the force of application, are kept substantially constant over the entire period of use of the hair treatment device. An application speed of between 1.8 and 2 m/s and a force of application of between 2.5 and 3.5 N are preferred.

The "initial quantity" is understood here to be the quantity of cosmetic product present in the applicator member before the first pass over the hair to be treated.

The "degree of filling of the applicator member" is understood here to be the ratio between the mass of cosmetic product effectively present in the applicator member and the maximum mass of cosmetic product with which the applicator member can be saturated. This degree of filling is measured at atmospheric pressure of 1.01325 $10^5$ Pa and a temperature of 22° C.

The degree of filling of the applicator member is preferably greater than a limit value, and notably greater than 40%, preferably greater than 50%, more preferably greater than 60%.

Figure 4:
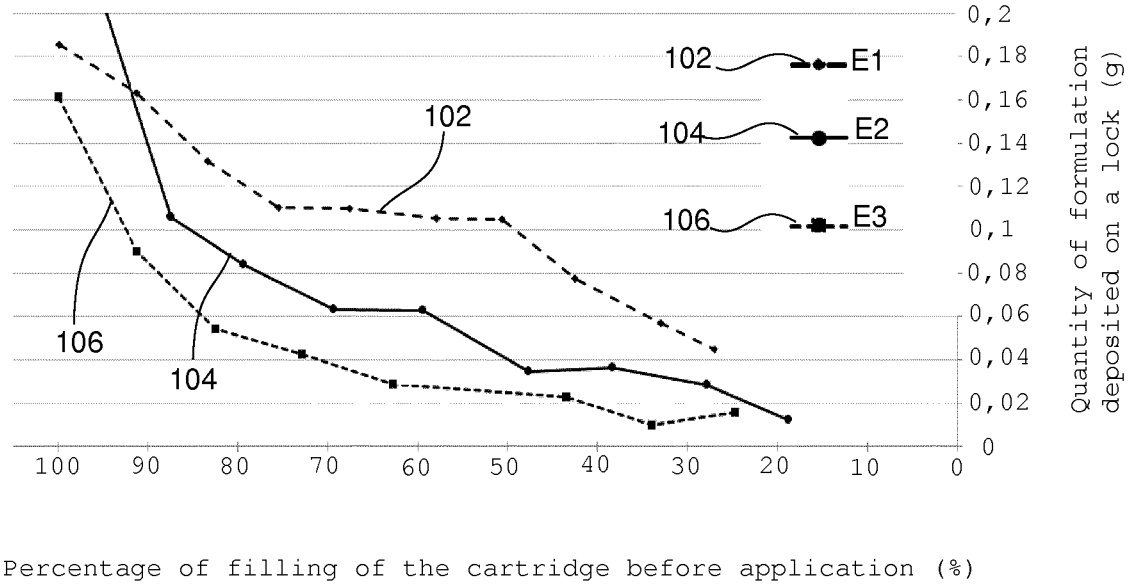
Figure 5:
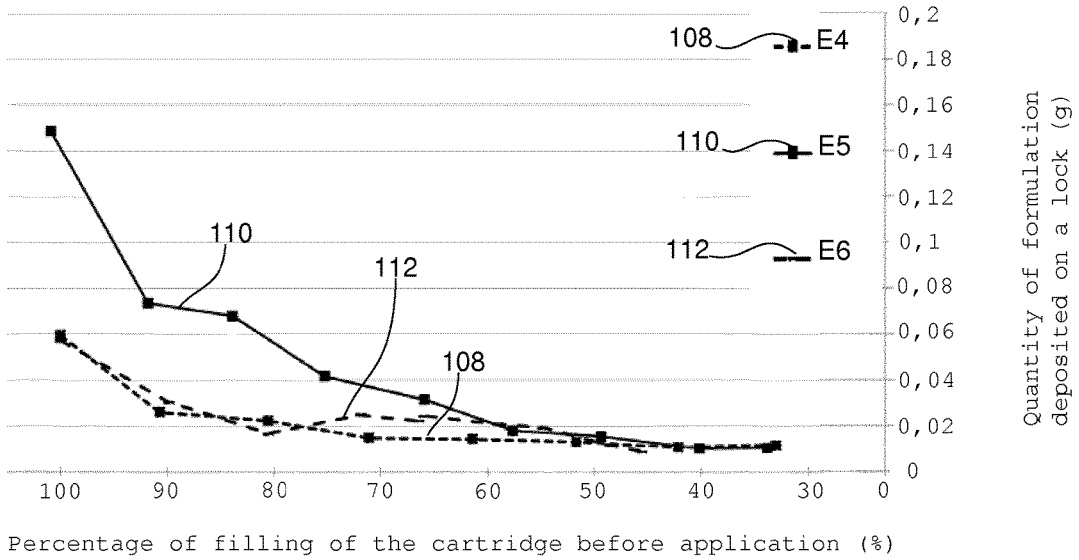
Figure 6:
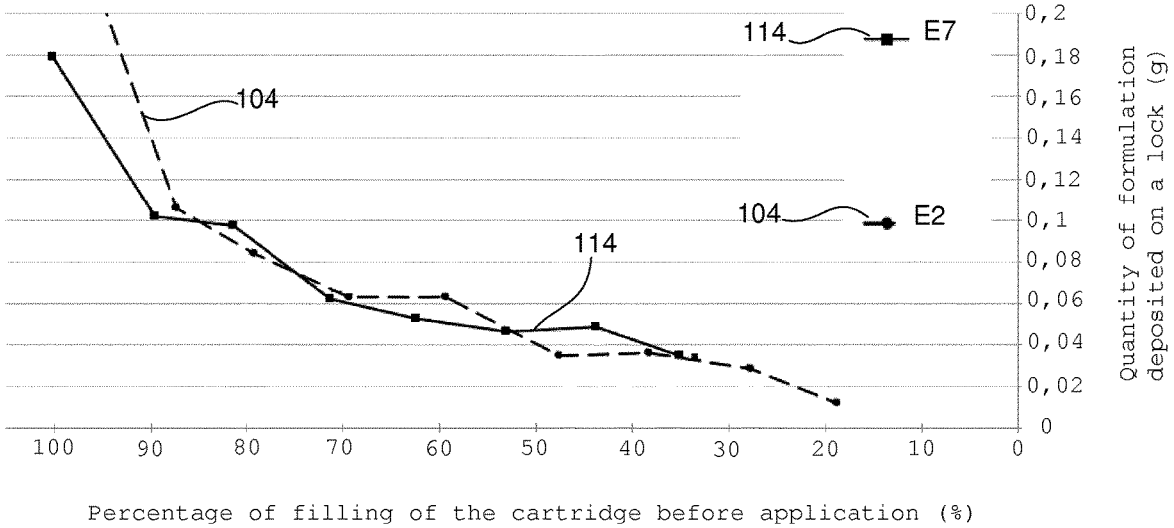

FIGS. 4 to 6 illustrate the quantity of cosmetic product delivered by different samples of applicator members on each pass, as function of the filling percentage of each of these applicator members. The force and speed of application are kept constant throughout the tests: the applicator member is passed over locks with a length of 27 cm and a width of 10.5 cm for 15 s, with a force of 3 N being applied to the applicator member in the direction of the locks.

In these three figures, the cosmetic product employed is the same. It is the composition obtained from the ingredients indicated in the following table:

| INCI name | Commercial reference | Quantity in % by weight |
|---|---|---|
| Cyclopentasiloxane | Silsoft 1202 LT from Momentive Performance Materials | 70 |
| Cyclopentasiloxane and dimethiconol | Silsoft 1215 LT from Momentive Performance Materials | 30 |

In these different figures, the following samples were tested:

| Sample | Density/ies [g/cm$^3$] | Composition | Orientation of the fibers |
|---|---|---|---|
| E1 | 0.1 | Polyethylene/Polypropylene 50%/50% Bonded nonwoven | Along the length of the applicator member |
| E2 | 0.15 | Polyethylene/Polypropylene 50%/50% Bonded nonwoven | Along the length of the applicator member |
| E3 | 0.18 | Polyethylene/Polypropylene 50%/50% Bonded nonwoven | Along the length of the applicator member |
| E4 | 0.36 | Polyethylene terephthalate Isophthalate copolymer | Along the length of the applicator member |
| E5 | 0.18 | High density polypropylene Polyethylene Polyethylene terephthalate (Polyester fibers) | Along the length of the applicator member |
| E6 | 0.25 | Polyacrylonitrile (Acrylic fiber) Nondisclosure Melamine formaldehyde resin | Along the length of the applicator member |
| E7 | 0.15/0.25 | Polyethylene/Polypropylene 50%/50% Bonded nonwoven | Along the length of the applicator member |

In all cases, the applicator member is in the form of a rectangular parallelepiped with dimensions of 8 mm×20 mm×90 mm.

The sample E7 comprises a parallelepipedal part with a density of 0.15 g/cm$^3$, having the function of a reservoir, and a parallelepipedal part with a density of 0.25 g/cm$^3$, one face of which is intended to be in contact with the hair in order to apply the cosmetic product. The volume of the reservoir part is twice that of the application part.

In FIGS. 4 to 6, the relative consistency of the quantity of cosmetic product delivered is represented by more horizontal curves in the filling range 0-90%, notably in the range 40-80%.

The tables in FIGS. 7 to 13 give the numeric values used to draw the curves in FIGS. 4 to 6. In these tables, a ratio 11 expressed in percent is also calculated, for each test of a sample, said ratio being defined, for each pass carried out, as the absolute value of the difference between the value of cosmetic product delivered during the pass in question, as measured, and the mean value of cosmetic product delivered over the different passes of the test, this difference being divided by this mean value.

This ratio shows that the variation in quantity of product delivered when the applicator member is saturated with less than 90% of cosmetic product is less than when it is saturated with more than 90%. For example, in the table in FIG. 7, the ration for filling of 99.9% is 70%, while it is less than 60% for all of the rest of the range tested, notably for filling less than 90%.

What is more, this table in FIG. 7 shows that the ratio 11 is less than 30% for the preferred range of filling of the applicator member of between 40% and 80%. In other words, in this range, the quantity of product delivered per pass of the applicator member does not vary by more than 30% compared with the mean value of cosmetic product delivered per pass during the test. Such a variation makes it possible to ensure homogeneity of hair treatment with the cosmetic product, all of the locks treated in the filling range of 40%-80%, better still 40%-70%, receiving more or less the same quantity of cosmetic product.

The table relating to the test of sample E2, in FIG. 8, indicates results similar to those for sample E1. The quantity of cosmetic product is very high for filling of 97.3%, corresponding to a value of the ratio Ti of more than 220%, while this ratio is less than 85% in the filling range of 15%-90%. What is more, for filling of between 40% and 80%, the ratio Ti is less than 50%, this ratio being even less than 20% in the range of 60%-80%.

The table in FIG. 9, relating to the test of sample E3, also shows that a very large variation in the quantity of cosmetic product delivered occurs depending on whether the applicator member is completely saturated with cosmetic product or is saturated at 90% or less. This table also shows that the variation in the ratio Ti is least in the range 40%-80%, better still 60%-80%.

The table in FIG. 10 shows substantially equivalent results for sample E4. The quantity of product delivered when the applicator member is completely saturated is very much greater than the quantity of cosmetic product delivered per pass of the applicator member when the latter is saturated at 90% or less. Notably, in the range 60%-80%, the quantity of cosmetic product delivered per pass does not vary by more than 35% compared with the mean value of the test.

The table in FIG. 11 also shows that the applicator member saturated at 90% or less makes it possible to deliver a substantially homogeneous quantity of cosmetic product, whereas the quantity of product delivered is very much greater when the applicator member is completely saturated. The same preferred range of 60%-80% can be determined here, where the ratio Ti remains less than 46.4%.

The table in FIG. 12 shows that sample E6, when completely saturated, delivers a very large quantity of cosmetic product, whereas the quantity of cosmetic product delivered is substantially more homogeneous when the applicator member is saturated at 90% or less, better still when it is saturated at between 55% and 80%.

The same finding emerges from viewing the table in FIG. 13, relating the test of sample E7: the variation in the quantity of cosmetic product delivered by the applicator member is less, when the latter is saturated at 90% cosmetic product at most, than when it is completely saturated.

The invention is not limited to the illustrative embodiments that have just been described, the features of which may be combined with one another within variants that are not illustrated.

Figure 14:
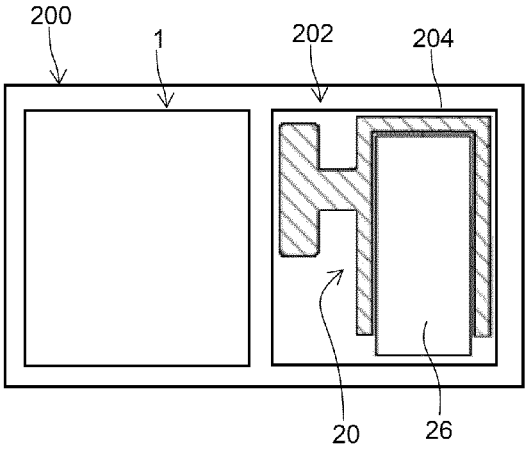

Thus, the invention relates, for example, to a ready-to-assemble assembly 200 as illustrated schematically in FIG. 14. This ready-to-assemble assembly 200 comprises a hair treatment device 1 and a cosmetic product refill article 202. This article comprises in this case a cosmetic product refill 20 in a package 204 which is closed so as to avoid, notably, any evaporation of the cosmetic product from the applicator member. In a variant, the package 204 may comprise a plurality of cosmetic product refills 20. In this case, it is preferred for the package to be able to be reclosed so that the other cosmetic product refills do not dry out when a refill is withdrawn from the package. In a variant, in this case, each individual refill is preserved in an individual package, inside a package common to the multiple refills.

The invention claimed is:

1. A cosmetic product refill for a hair treatment device, the refill comprising:

a body comprising a unique cavity opening toward the outside by way of an opening of the body, the entire body being configured to be removably fastened to an arm of the hair treatment device, a liquid cosmetic product contained in a unique reservoir of product within the refill, an applicator member in a porous material inserted in the cavity through the opening of the body and filling entirely the cavity, the applicator member being the unique reservoir of product within the refill, the applicator member being initially impregnated with the liquid cosmetic product, the initial quantity of liquid cosmetic product impregnating the applicator member corresponding to a degree of filling of the applicator member greater or equal than 40% and less than or equal to 90%, wherein the applicator member is configured such that a ratio $\eta$ expressed in percent is less than 60%, for each test of a sample, said ratio being defined, for each pass carried out, as the absolute value of the difference between the value of cosmetic product delivered during the pass in question, as measured, and the mean value of cosmetic product delivered over the different passes of the test, this difference being divided by this mean value.

2. The cosmetic product refill as claimed in claim 1, the degree of filling of the applicator member being greater or equal than 40% and less than or equal to 80%.

3. The cosmetic product refill as claimed in claim 1, wherein the applicator member is entirely porous.

4. The cosmetic product refill as claimed in claim 1, wherein the applicator member is made of felt.

5. The cosmetic product refill as claimed in claim 4, the fibers of the felt all being oriented substantially in the same direction and molded so as to form the felt.

6. The cosmetic product refill as claimed in claim 1, wherein the density of the applicator member is greater than 0.08 g/cm$^3$ and/or less than 0.350 g/cm$^3$.

7. The cosmetic product refill as claimed in claim 1, wherein the viscosity of the liquid cosmetic product is greater than 4 centipoise and/or less than 500 centipoise.

8. The cosmetic product refill as claimed in claim 1, wherein the applicator member has an elongate shape, with a rectangular or cruciform cross section, with a flat, pointed or rounded end that is intended to be in contact with the hair to be treated, and/or with one or two bevels.

9. The cosmetic product refill as claimed in claim 1, wherein the applicator member is made at least partially of polyethylene, of polypropylene, or of a mixture of polyethylene and polypropylene.

10. The cosmetic product refill as claimed in claim 1, wherein the liquid cosmetic product is an aqueous composition.

11. The cosmetic product refill as claimed in claim 10, the viscosity of the liquid cosmetic is greater than 4 centipoise and/or less than 500 centipoise.

12. The cosmetic product refill as claimed in claim 10, the applicator member having a density greater than 0.11 g/cm$^3$ and/or less than 0.25 g/cm$^3$.

13. The cosmetic product refill as claimed in claim 1, wherein the liquid cosmetic product is an anhydrous composition.

14. The cosmetic product refill as claimed in claim 13, the viscosity of the liquid cosmetic is greater than 100 centipoise and/or less than 600 centipoise.

15. The cosmetic product refill as claimed in claim 13, the applicator member having a density greater than 0.11 g/cm$^3$ and/or less than 0.25 g/cm$^3$.

16. A cosmetic product refill article comprising a closed package and at least one cosmetic product refill as claimed in claim 1, contained in the package.

17. A hair treatment device comprising:

at least one arm, a cosmetic product refill as claimed in claim 1, which is mounted on the arm.

18. The device as claimed in claim 17, comprising at least one heating element.

19. A method for treating the hair, comprising the step of applying a cosmetic product to a lock of hair using a device as claimed in claim 17.

20. The cosmetic product refill as claimed in claim 1, wherein the body includes a rib that is configured to be slidably fastened to into a groove in the arm of the hair treatment device.

21. The cosmetic product refill as claimed in claim 1, wherein the refill is deprived of any supply of liquid cosmetic product from outside the refill.

* * * * *